US008763193B1

(12) United States Patent
Thompson et al.

(10) Patent No.: US 8,763,193 B1
(45) Date of Patent: Jul. 1, 2014

(54) INTERLOCKING BRUSHES

(71) Applicants: Joseph Charles Thompson, Coppell, TX (US); Jonathan B. Filipski, Carrollton, TX (US)

(72) Inventors: Joseph Charles Thompson, Coppell, TX (US); Jonathan B. Filipski, Carrollton, TX (US)

(73) Assignee: BASE4 Group, Inc., Carrollton, TX (US)

( * ) Notice: Subject to any disclaimer, the term of this patent is extended or adjusted under 35 U.S.C. 154(b) by 0 days.

(21) Appl. No.: 13/773,133

(22) Filed: Feb. 21, 2013

(51) Int. Cl.
*A46B 15/00* (2006.01)

(52) U.S. Cl.
USPC ..... 15/106; 15/111; 15/202; D4/118; D4/119; D4/121; D4/129

(58) Field of Classification Search
CPC .. A46B 5/0004; A46B 5/0008; A46B 5/0095; A46B 7/00; A46B 7/04; A46B 7/042; A46B 15/00
USPC ..... 15/106, 111, 184, 202; D4/116–121, D4/129
See application file for complete search history.

(56) References Cited

U.S. PATENT DOCUMENTS

| | | | | | |
|---|---|---|---|---|---|
| 2,648,082 | A | * | 8/1953 | Teetsel | 15/106 |
| 5,491,863 | A | * | 2/1996 | Dunn | 15/106 |
| 5,517,710 | A | * | 5/1996 | Hisey | 15/106 |
| D388,617 | S | * | 1/1998 | Ancona et al. | D4/138 |
| D410,147 | S | * | 5/1999 | King et al. | D4/138 |
| 6,574,822 | B1 | * | 6/2003 | Osiecki et al. | 15/106 |
| 7,000,281 | B1 | * | 2/2006 | Morad | 15/106 |
| 2011/0225756 | A1 | * | 9/2011 | Chapman et al. | 15/159.1 |

FOREIGN PATENT DOCUMENTS

| | | | |
|---|---|---|---|
| JP | 8-89343 | * | 4/1996 |
| JP | 2008-259670 | * | 10/2008 |

* cited by examiner

*Primary Examiner* — Mark Spisich
(74) *Attorney, Agent, or Firm* — W. Thomas Timmons

(57) ABSTRACT

A first brush has an elongated handle, a brush head having downwardly facing bristles and a cavity opened to the top of the brush head. A second brush includes a closed loop handle, a brush head having downwardly facing bristles, a scraper on the front of the brush head and a latch on the back. The second brush fits snugly into the cavity of the first brush with the bristles of the second brush facing into the cavity, and the handle in an upward position extending outwardly from the cavity. The scraper slides into a slot on the front end of the cavity and the latch firmly attaches the second brush to the first brush. When the brushes are attached, the two brushes act as a single brush with two handles, allowing a user to apply direct pressure to the brush head of the first brush.

7 Claims, 3 Drawing Sheets

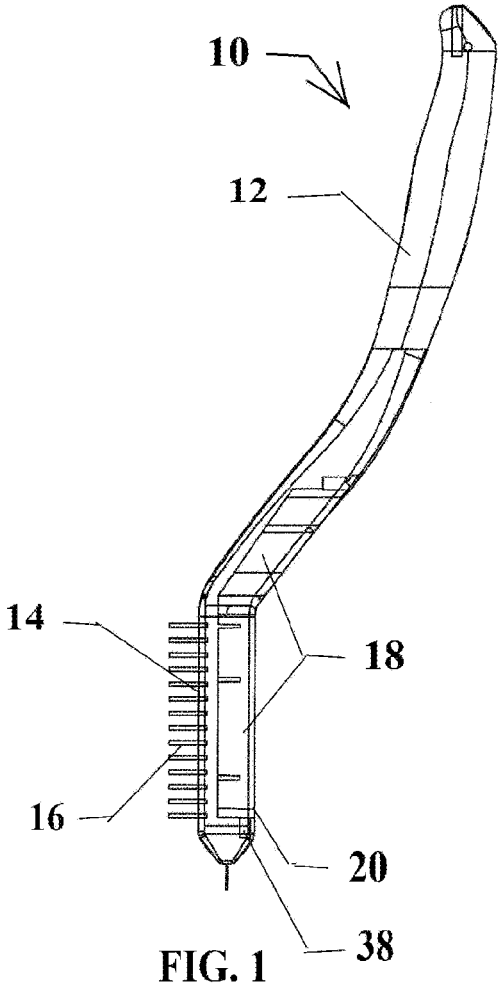
FIG. 1
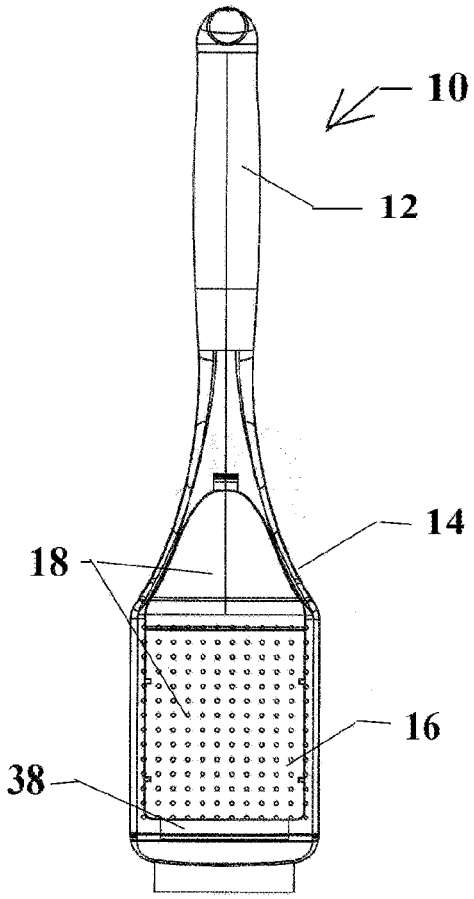
FIG. 2
FIG. 3
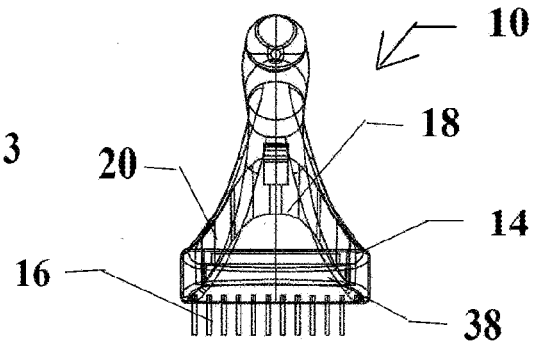

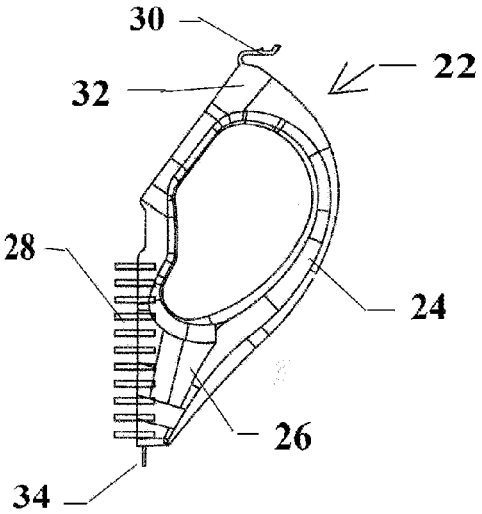
FIG. 4
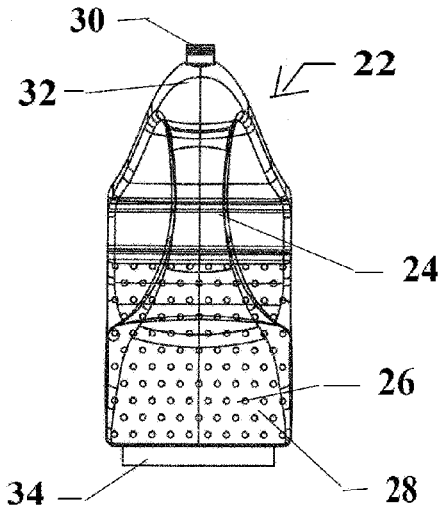
FIG. 5
FIG. 6
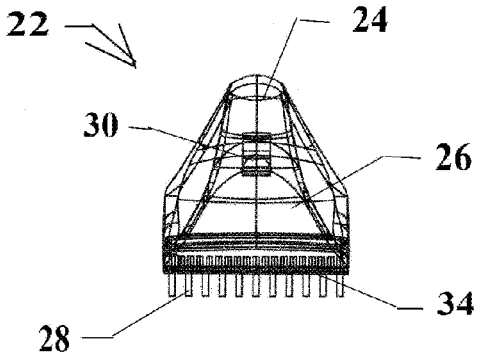

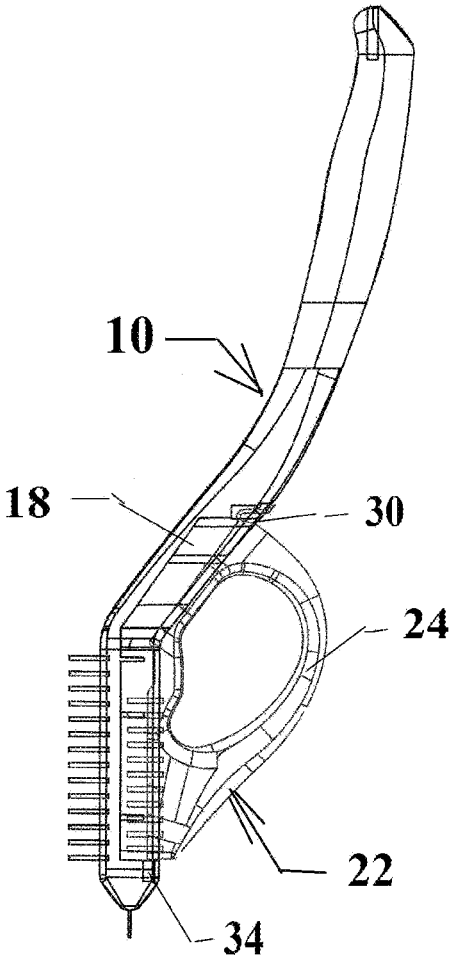
FIG. 7
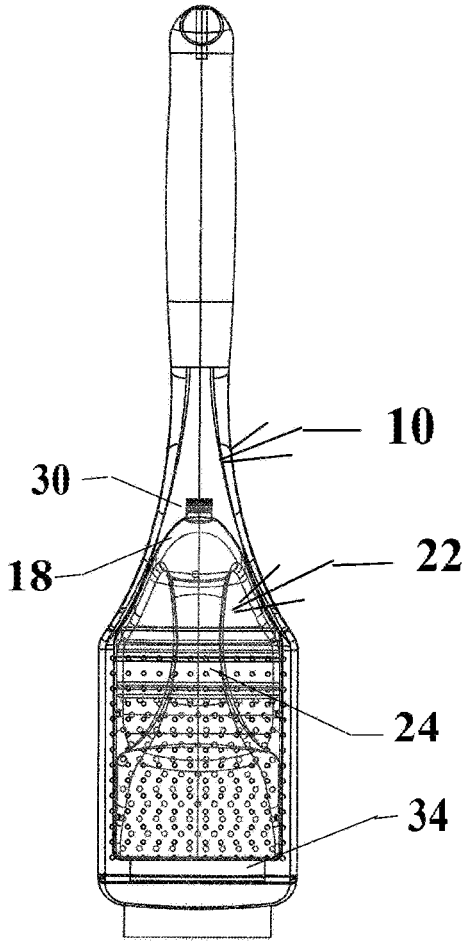
FIG. 8
FIG. 9
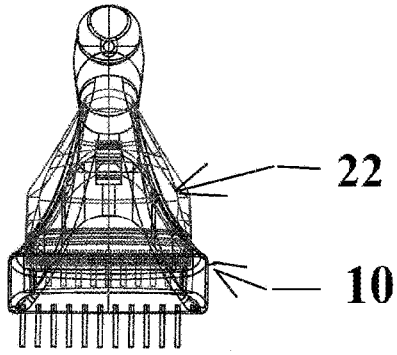

INTERLOCKING BRUSHES

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The field of the invention, in general, relates to brushes and in one of its aspects to grill brushes 2. Description of Related Art Grill brushes are old in the art, and frequently people who cook regularly on a grill will have brushes of various sizes.

BRIEF SUMMARY OF THE INVENTION

Interlocking brushes according to the present invention include a first brush having an elongated handle, a brush head attached to one end of the elogated handle, the brush head having a plurality of downwardly facing bristles and a cavity in the brush head. The cavity is open to the top side, which is the side opposite the downwardly facing bristles.

A second brush includes a substantially closed loop handle, a brush head attached to the substantially closed loop handle, the brush head having a plurality of downwardly facing bristles and a latch. The handle of the second brush is a closed loop in a preferred form.

The second brush fits snugly into the cavity of the first brush with the bristles of the second brush facing into the cavity. The handle of the second brush is in an upward position extending outwardly from the cavity. The latch of the second brush firmly attaches the second brush to the first brush. When the second brush is attached to the first brush, the two brushes act as a single brush with two handles. When the second brush is attached to the first brush, the handle of the second brush allows a user to apply direct pressure to the brush head of the first brush.

The second brush further includes a scraper extending from the front of the brush head. The cavity in the first brush includes a slot in the front end so that the scraper on the front end of the brush head of the second brush slides into the slot inside the cavity. In such an arrangement, the latch on the second brush is on the back of the second brush opposite the scraper. In this way, the scraper in the slot secures one end of the second brush in the cavity and the latch secures the opposite end of the second brush in the cavity.

The invention as described is suitable for many types of brushes but is particularly well suited for grill brushes.

These and other objects, advantages and features of this invention will be apparent from the following description taken with reference to the accompanying drawing, wherein is shown a preferred embodiment of the invention.

BRIEF DESCRIPTION OF THE SEVERAL VIEWS OF THE DRAWING

FIG. 1 is a left side view of a first brush according to the present invention;

FIG. 2 is a top view of a first brush according to FIG. 1;

FIG. 3 is a front view of a first brush according to FIG. 1 and FIG. 2;

FIG. 4 is a left side view of a second brush according to the present invention;

FIG. 5 is a top view of a second brush according to FIG. 4;

FIG. 6 is a front view of a second brush according to FIG. 4 and FIG. 5;

FIG. 7 is a left view of interlocked first and second brushes according to the present invention;

FIG. 8 is a top view of interlocked first and second brushes according to FIG. 7; and FIG. 9 is a front view of interlocked first and second brushes according to FIG. 7 and FIG. 8.

DETAILED DESCRIPTION OF THE INVENTION

Referring now to the drawing, and in particular to FIGS. 1 through 3, interlocking brushes according to the present invention include a first brush 10 having an elongated handle 12, a brush head 14 attached to one end of the elogated handle, the brush head having a plurality of downwardly facing bristles 16 and a cavity 18 in the brush head. Cavity 18 is open to the top side 20, which is the side opposite downwardly facing bristles 16.

Referring now to FIGS. 4 through 6, a second brush 22 includes a substantially closed loop handle 24, a brush head 26 attached to the substantially closed loop handle, the brush head having a plurality of downwardly facing bristles 28 and a latch 30 on the back 32 of brush head 26. Handle 24 of second brush 22 is a closed loop in a preferred form.

Referring now to FIGS. 7 through 9, second brush 22 fits snugly into cavity 18 of first brush 10 with the plurality of bristles 28 of the second brush facing into the cavity. Substantially closed loop handle 24 of the second brush is in an upward position extending outwardly from cavity 18. Latch 30 of the second brush firmly attaches the second brush to the first brush. When the second brush is attached to the first brush, the two brushes act as a single brush with two handles. When the second brush is attached to the first brush, the handle of the second brush allows a user to apply direct pressure to the brush head of the first brush.

The second brush further includes a scraper 34 extending from the front of brush head 26. The cavity in the first brush includes a slot 38 in the front end so that the scraper on the front end of the brush head of the second brush slides into the slot inside the cavity. In such an arrangement, the latch on the second brush is on the back of the second brush opposite the scraper. In this way, the scraper in the slot secures one end of the second brush in the cavity and the latch secures the opposite end of the second brush in the cavity.

It can now be seen that the interlocking brushes of the present invention are well suited for grill brushes, both separately and in interlocked combination.

From the foregoing it will be seen that this invention is well adapted to attain all of the ends and objectives hereinabove set forth, together with other advantages which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the figures of the accompanying drawings is to be interpreted as illustrative and not in a limiting sense.

The invention claimed is:

1. Interlocking brushes, comprising in combination:

a first brush having:

an elongated handle;

a brush head attached to one end of the elongated handle, the brush head having a plurality of downwardly facing bristles; and a cavity in the brush head, open to the top side, the side opposite the downwardly facing bristles; and a second brush having:

a substantially closed loop handle;

a brush head attached to the substantially closed loop handle, the brush head having a plurality of downwardly facing bristles; and a latch;

wherein the second brush fits snugly into the cavity of the first brush with the plurality of bristles of the second brush facing into the cavity and the handle of the second brush is in an upward position extending outwardly from the cavity, and wherein the latch of the second brush firmly attaches the second brush to the first brush, whereby when the second brush is attached to the first brush, the two brushes act as a single brush with two handles.

2. Interlocking brushes according to claim 1 wherein when the second brush is attached to the first brush, the handle of the second brush allows a user to apply direct pressure to the brush head of the first brush.

3. Interlocking brushes according to claim 2 wherein the handle of the second brush is a closed loop handle.

4. Interlocking brushes according to claim 3 wherein the second brush further includes a scraper extending from the front of the brush head, and the cavity in the first brush includes a slot in the front end, wherein the scraper on the front end of the brush head of the second brush slides into the slot inside the cavity and the latch on the second brush is on the back of the second brush opposite the scraper, whereby the scraper in the slot secures one end of the second brush in the cavity and the latch secures the opposite end of the second brush in the cavity.

5. Interlocking brushes according to claim 1 wherein the handle of the second brush is a closed loop handle.

6. Interlocking brushes according to claim 5 wherein the second brush further includes a scraper extending from the front of the brush head, and the cavity in the first brush includes a slot in the front end, wherein the scraper on the front end of the brush head of the second brush slides into the slot inside the cavity and the latch on the second brush is on the back of the second brush opposite the scraper, whereby the scraper in the slot secures one end of the second brush in the cavity and the latch secures the opposite end of the second brush in the cavity.

7. Interlocking brushes according to claim 1 wherein the second brush further includes a scraper extending from the front of the brush head, and the cavity in the first brush includes a slot in the front end, wherein the scraper on the front end of the brush head of the second brush slides into the slot inside the cavity and the latch on the second brush is on the back of the second brush opposite the scraper, whereby the scraper in the slot secures one end of the second brush in the cavity and the latch secures the opposite end of the second brush in the cavity.

* * * * *